US006250119B1

(12) United States Patent
Flon

(10) Patent No.: US 6,250,119 B1
(45) Date of Patent: Jun. 26, 2001

(54) MORTISE LOCK

(76) Inventor: Michel Flon, 591 chaussee de Jette, B-1090 Brussels (BE)

( * ) Notice: Subject to any disclaimer, the term of this patent is extended or adjusted under 35 U.S.C. 154(b) by 0 days.

(21) Appl. No.: 09/341,114

(22) PCT Filed: Jan. 8, 1997

(86) PCT No.: PCT/BE97/00001

§ 371 Date: Jul. 7, 1999

§ 102(e) Date: Jul. 7, 1999

(87) PCT Pub. No.: WO98/30773

PCT Pub. Date: Jul. 16, 1998

(51) Int. Cl.[7] ..... E05B 47/00
(52) U.S. Cl. ..... 70/279.1; 70/448; 70/280
(58) Field of Search ..... 70/277, 278.1, 70/278.3, 279.1, 283, 107, 108, 448, 451; 292/336.3, 32–36

(56) References Cited

U.S. PATENT DOCUMENTS

| | | | | |
|---|---|---|---|---|
| 4,509,347 | * | 4/1985 | Young | 70/279.1 X |
| 4,677,834 | * | 7/1987 | Hicks | 70/279.1 |
| 4,685,709 | * | 8/1987 | Kambic | 70/279.1 X |
| 4,776,619 | * | 10/1988 | Daugherty et al. | 70/279.1 X |
| 4,949,563 | * | 8/1990 | Gerard et al. | 70/279.1 |
| 5,487,289 | * | 1/1996 | Otto, III et al. | 70/279.1 |
| 5,531,086 | * | 7/1996 | Bryant | 70/279.1 |
| 5,626,039 | * | 5/1997 | Solari et al. | 70/279.1 |
| 5,722,269 | * | 3/1998 | Simon et al. | 70/448 X |
| 5,841,347 | * | 11/1998 | Kim | 70/278.1 X |
| 6,032,500 | * | 3/2000 | Collard, Jr. et al. | 70/280 X |

FOREIGN PATENT DOCUMENTS

| | | | | |
|---|---|---|---|---|
| 793542 | * | 9/1968 | (CA) | 70/278.1 |
| 671 263 | | 8/1989 | (CH) . | |
| 44 01 971 | | 8/1995 | (DE) . | |
| 389728 | * | 10/1990 | (EP) | 70/279.1 |
| 482588 | * | 4/1992 | (EP) | 70/279.1 |
| 2 635 553 | | 2/1990 | (FR) . | |
| 2646871 | * | 11/1990 | (FR) | 70/158 |
| 2 667 105 | | 3/1992 | (FR) . | |
| 2 712 336 | | 5/1995 | (FR) . | |
| 2179696 | * | 3/1987 | (GB) | 70/279.1 |

* cited by examiner

*Primary Examiner*—Suzanne Dino Barrett
(74) *Attorney, Agent, or Firm*—Birch, Stewart, Kolasch & Birch, LLP

(57) ABSTRACT

The invention concerns a multipoint electric lock, comprising at least two mutually spaced locking devices, a rod assembly directly connecting the locking devices together, integral with a housing, which slides in the housing, guided thereon by means of the locking devices, an electric motor constituting an actuating device, integral with the housing, and a transmission mechanism which ensures the transmission of movement between the actuating device and the rod assembly.

17 Claims, 4 Drawing Sheets

MORTISE LOCK

TECHNICAL FIELD

The object of the present invention is a mortise lock of the type comprising a chute-type housing closed by a cover and accommodating the entire lock actuating and bolting mechanism, this mechanism consisting of an actuating device, a control rod assembly, movable longitudinally in the housing, and of at least one similar bolt or locking device, disposed so as to be spaced from the actuating device and capable of projecting from the housing when the lock is in the closed position, the rod assembly ensuring the connection between the actuating device and locking device.

PRIOR ART

A device of this type is known, in particular, for making multipoint locks actuated by a mechanical device and is generally designed so as to be projecting on the inner side of the door.

In this type of device, the drive mechanism of the lock is formed of a complete assembly operating independently of the housing and inserted therein, the rod assembly simply ensuring a connection between the actuating elements that are projecting from the drive mechanism and the locking devices.

Locking mechanisms are also known that are to be built into a door, generally in the stile of the door; this stile is either a wood piece or even a rectangular profiled metal section in the case of a metal door. In this case, these are complete sets: a complete lock with a bolt integrated in a casing or, in the case of multipoint locks, a lock integrated in a casing and deflectors that are built into the door, generally by mortising to the position of the lock and deflectors, with these elements then being connected by a rod assembly introduced longitudinally into the stile of the door.

When an electric lock is used, for obvious security reasons, one generally installs a lock having a mechanical opening device for the lock in case of a power failure. In this case, one is obliged, due to the mortising system of the lock in a mortise formed in the stile (generally a profiled metal section in the case of a metal door), to house a complete lock in the mortise comprising, in a single mortisable casing, the electric lock, the mechanical opening system and the bolt or locking device.

The document DE 44 01 971 A discloses a lock comprising a chute-type housing which accommodates the locking mechanism, the lock comprising an actuating device which is an electric motor and a control rod assemble, longitudinally movable in the housing. In this prior document, the lock is a multipoint electric lock, comprising at least two locking devices spaced from one another, the rod assembly directly connects locking devices together, integral with the housing, and slides in the housing by being guided thereon by means of said locking devices, any accessories it may have, but also to include, easily and effectively, in the form of mechanisms acting on the rod assembly the actuating device is an electric motor, a transmission mechanism ensures the transmission of movement between the actuating device and the rod assembly, the electric motor that consists of an actuating device controls the rod assembly both in the direction of closing and opening, via the transmission, and an auxiliary mechanical actuating device is also provided to control the rod assembly in the direction of opening.

In this embodiment, the lock consists of several separate sets, namely a chute-type housing, containing the rod assembly and the bolts, an actuating mechanism comprising the actuating device and the transmission, and a mechanical lock acting on the entire actuating mechanism

DESCRIPTION OF THE INVENTION

The present invention applies generally to electric mortise locks for doors which have metal stiles. It applies, in particular, to locks for such doors that include metal stiles as parts of the frame, either of the opening or of the casing of the door.

An object of the present invention is to rationalize the manufacture of both the mortise locks and doors having such locks.

This object is attained by providing that, in a lock of the type described in the preamble of claim 1, in addition to the rod assembly, the housing accommodates the actuating device as well as the auxiliary mechanical actuating device and the actuating device and the auxiliary mechanical actuating device are separate from one another and arranged in separate locations in the housing, along the rod assembly.

An arrangement of this type in which the various elements of the lock mechanism are distributed over the rod assembly and are directly accessible on the entire housing, do not only permit one to simplify the installation of the lock and any accessories it may have, but also to include it easily and effectively in the form of mechanisms acting on the rod assembly and distributed over said rod assembly, a series of additional elements that permit, in a simple and inexpensive manner, the realization of reliable devices that increase the number of functions that can be carried out by the lock.

Advantageous embodiments of the lock of the invention are the subject of the subclaims.

Moreover, the fact of providing that the housing of the lock constitutes the door stile greatly simplifies the integration of the lock in the door during manufacture of the door, thus greatly reducing the cost of installing the lock on the door.

BRIEF DESCRIPTION OF THE DRAWINGS

The invention will be better understood with reference to the description and the attached drawings which schematically illustrate, only by way of example, various embodiments of the invention and in which.

The same reference numbers designate the same elements in the various embodiments described in the present application.

Figure 1:
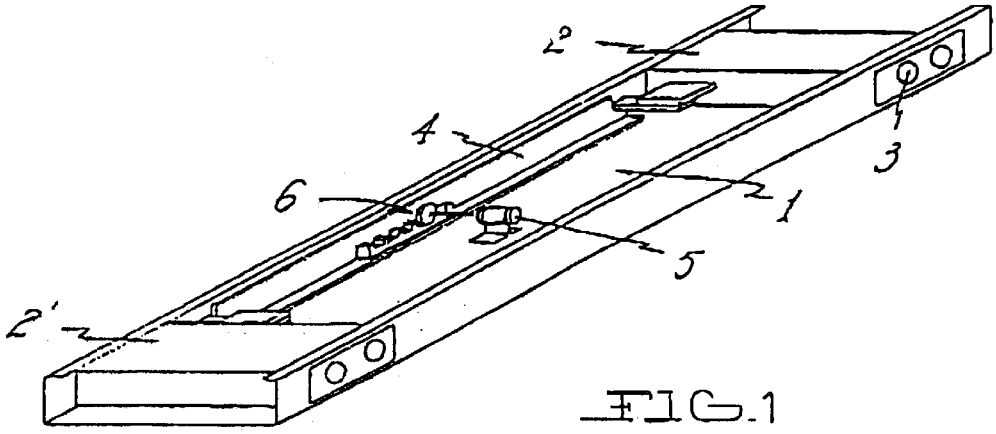
FIG. 1 shows an extremely simplified embodiment of a lock according to the invention.

With reference to the simplified embodiment of FIG. 1, a lock according to the invention comprises a chute-type housing 1, with which two mutually spaced locking devices 2, 2' are integrally connected, in the present case deflectors which control the outlet of the bolt 3. A rod assembly 4 extends between the deflectors 2, 2' and slides in the housing 1 on which it is guided by means of the deflectors 2, 2'. An electric motor 5, integral with the housing 1 on which it is mounted, actuates the rod assembly 4 by means of a transmission mechanism 6 that consists, in the example shown, of a rack and pinion system. A cover, not shown, and which is not part of the invention, is provided for closing the chute by any known means.

The advantage of an arrangement of this type is, on one hand, making the rod assembly like an element driven by the movement initiated by the actuating device and thus enabling the number of different actuating devices to be increased along the rod assembly while more easily decoupling the rod assembly from these various actuating devices and, on the other hand, to thus rationalize and simplify the manufacture and installation of various actuating devices that do not have to be mutually integrated. As can be seen below, this arrangement also makes it possible to appreciably increase, in a simple and reliable manner, the number of functions that can be carried out by the lock.

Figure 4:
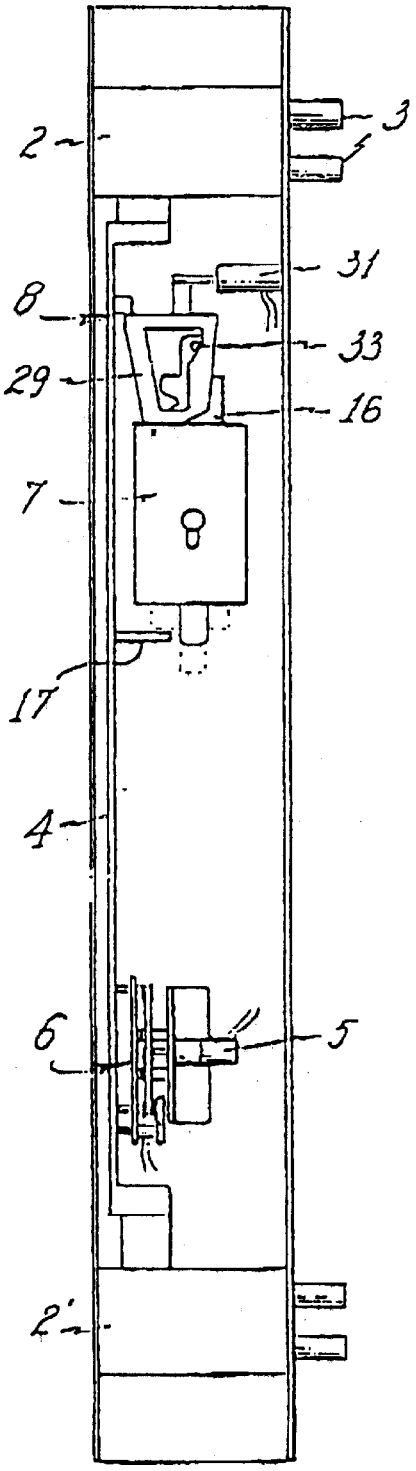
FIG. 4 is a schematic plan view of a first preferred embodiment of a lock according to the invention.

A first preferred embodiment of the invention is shown in FIG. 4.

According to this embodiment, the lock of the invention comprises, as in the embodiment of FIG. 1, a chute-type housing that is integral with two deflectors 2, 2' that control the movement of the bolts 3 between a projecting position as shown in FIG. 4, corresponding to the closure of the lock, and a retracted position as shown in FIG. 1, corresponding to the opening of the lock. A rod assembly 4 slides in the housing 1, resting against the deflectors 2, 2' by means of which it is guided in the housing 1.

An electric motor 5 drives the rod assembly by means of a transmission 6'.

Moreover, an auxiliary mechanical actuating device 7 is provided to operate at a location on the rod assembly separate from the transmission 6', in order to enable the opening of the lock by the action of a key in case of a power failure.

According to the preferred embodiment of the invention shown in FIG. 4, the auxiliary mechanical actuating device 7 also comprises a locking device 8 of the rod assembly in a closed position of the lock. If a locking device of this type were, in fact, omitted then any action exerted on the rod assembly 4 in the direction of opening of the lock would effectively result in the opening of the lock. Moreover, this auxiliary mechanical actuating device 7 is provided to control the rod assembly 4 only in the direction of opening.

Figure 2:
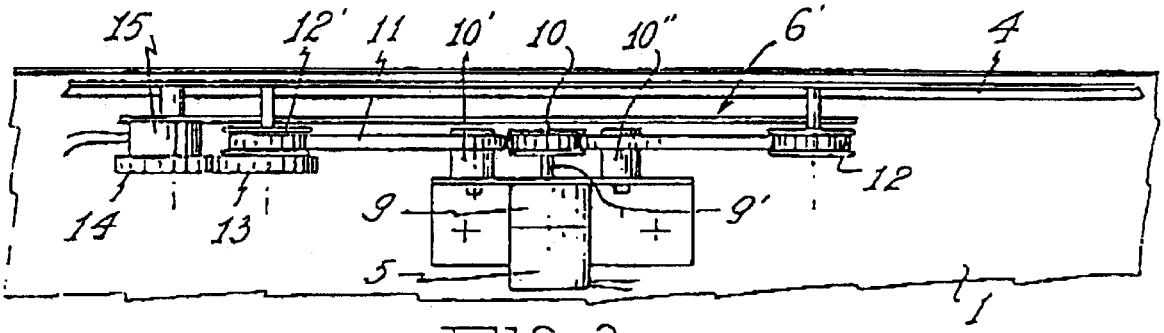
FIG. 2 is a plan view of the actuating device, of one part of the rod, and a preferred embodiment of the transmission device between the actuating device and the rod.
Figure 3:
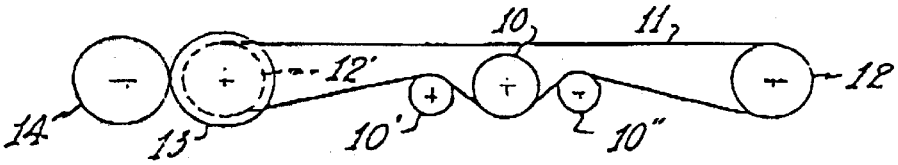
FIG. 3 is a schematic side view of the transmission mechanism of FIG. 2.

The various aforementioned elements, in particular the transmission 6', the auxiliary mechanical actuating device 7 and the locking device 8 of the rod assembly shall be described in greater detail below with reference to FIGS. 2 and 3, 5, and 6, respectively. FIGS. 2 and 3 show a preferred embodiment of a transmission 6' between the electric motor 5 and the rod assembly 4, that adapts in particular to the interaction with an auxiliary mechanical actuating device 7 of the rod assembly 4. In fact, generally, it uses electric motors 5 having a significant rotational speed that, therefore, necessitate the use of a speed reducer 9. In a case of this type, the motor drive from the output shaft 9' of the speed reducer 9, a drive that occurs, if an appropriate device is not provided, when the rod assembly is actuated toward the open position by the auxiliary mechanical actuating device, requires a significant torque, and thus a great effort on the key actuating the auxiliary mechanical actuating device.

In this perspective, the transmission 6' permits disengagement of the motor in case of a power failure. In the embodiment illustrated in the patent, this disengagement takes place as follows. The transmission 6' consists, on the one hand, of a motor pinion gear 10 situated on the end of the output shaft 9' of the speed reducer 9 and, on the other hand, of a notched belt 11 winding about two pulleys 12, 12' that pivot on an axis that is integral with the rod assembly 4, the interaction of the pinion 10 with the notched belt 11 being ensured by the tension rollers 10', 10". The pulley 12' is integral with a pinion 13 engaging with a pinion 14 controlled by an electromagnetic coupling 15 attached to the rod assembly 4 so as to be fixed.

When the electromagnetic coupling 15 is supplied with power, and the electric control of the lock can function normally, the pinion 14 is immobilized in rotation, thereby blocking the pulley 12', and thus the winding of the notched belt 11 on the pulleys 12, 12'. The notched belt 11 is then immobile vis-à-vis the rod assembly 4. In this case, the rotation of the motor 5 results in the displacement of the notched belt 11 vis-à-vis the pinion 10, without winding of the notched belt 11 on the pulleys 12, 12' and thus the displacement of the rod assembly 4 vis-à-vis the pinion 10.

When the power supply of the lock, and thus the electromagnetic coupling, is interrupted, the pinion 14 can pivot freely. As a result, a displacement of the rod assembly 4 vis-à-vis the pinion 10 results in the winding of the notched belt 11 on the pulleys 12, 12' without resulting in the pivoting of the pinion 10. The operation of the rod assembly by the auxiliary mechanical actuating device is thus facilitated.

Figure 5:
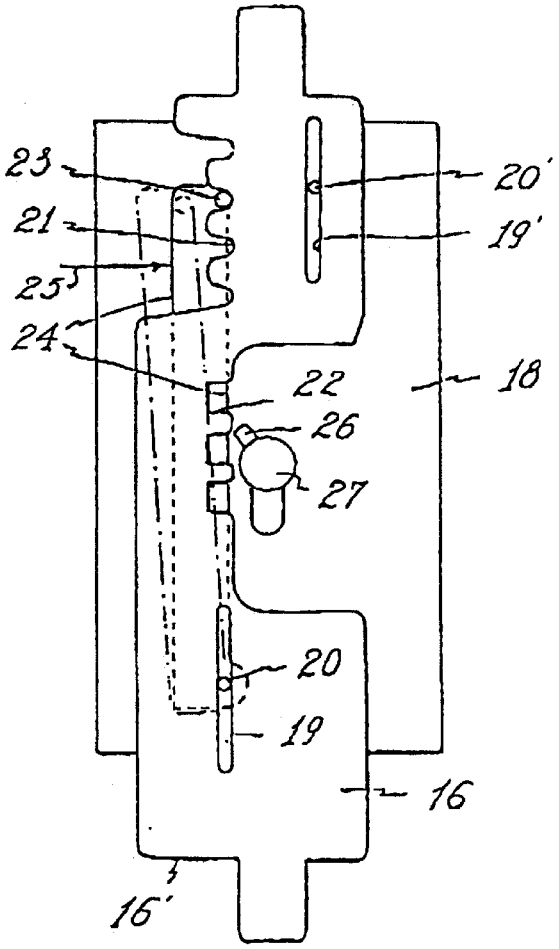
FIG. 5 is a schematic plan view showing the interaction of the various elements of a preferred embodiment of an auxiliary mechanical actuating device of the rod assembly according to the invention.

FIG. 5 schematically shows the functioning of essential parts of an auxiliary mechanical actuating device for the rod assembly as shown at 7 in FIG. 4. This device essentially comprises, as a mobile element, a control arm 16 whose lower side 16' is intended to interact with a projection 17 formed on the rod assembly 4 to act on the rod assembly only in the direction of opening of the lock.

The control arm 16 moves on a support 18, integral with the housing 1, by means of slots 19, 19' formed in the control arm, slots that interact with pins 20, 20', integral with the support 18. The support 18 is disposed in the housing 1 in such a way that the movement of the arm on the support performs, at least substantially, a parallel movement in the direction of movement of the rod assembly.

The control arm 16 comprises two series of notches, a locking series of notches 21 and a series of actuating notches 22, respectively.

The locking notches 21 interact successively with a pin 23 carried by a lever 24 that oscillates on the support and constantly moves in the direction of arrow 25 by a spring, not shown, that tends to bring the pin 23 into interaction with a locking notch 21. In the example shown, the lever 24 oscillates around the pin 20.

The actuating notches 22 interact with the bolt 26 of a lock cylinder 27, in whose sphere of action bolt 26 also penetrates the lever 24. The rotation of the bolt then causes, on the one hand, the pivoting of the lever 24 and its pin 23 toward a position spaced from the locking notches 21 and, on the other hand, the movement, at a distance from a notch, of the actuating arm 16 by action of the bolt 26 on the wall of the corresponding actuating notch 22. Going on with the rotation of the bolt until it is released from the actuating notch 22 enables the lever 24 to return in direction of arrow 25, so that the pin 23 engages in the next locking notch 21. The total course of the actuating arm 16 and thus the number of turns of the bolt is thus provided to ensure, by an action on the projection 17, a movement of the rod assembly 4 corresponding to a complete opening of the door.

According to a preferred embodiment of this auxiliary mechanical actuating device 7, the control arm 16 consists of two parallel plates having the same profile, assembled so as to be spaced from one another, and the lever 24 that carries the locking pin 23 is arranged between the plates that make up the control arm 16.

Figure 6:
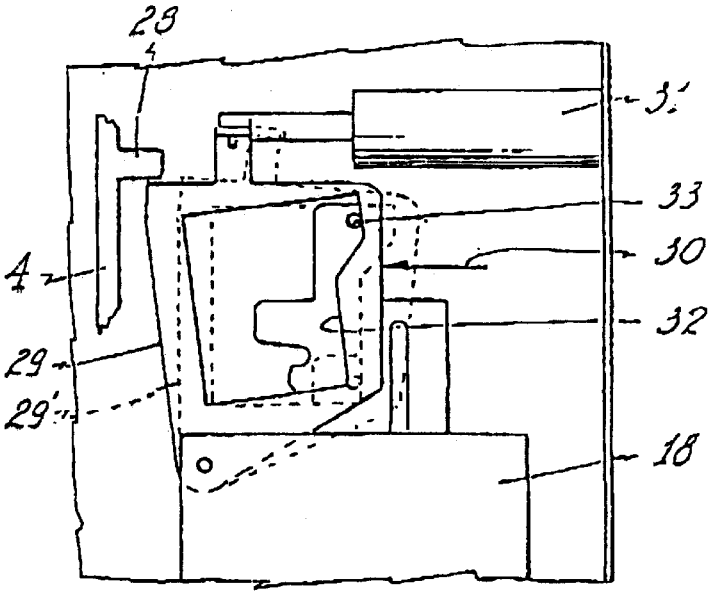
FIG. 6 is a schematic view of a preferred embodiment of the locking mechanism of the rod assembly according to the invention.

According to the embodiment of the invention shown in FIG. 4, the electric control of the door, as well as the auxiliary mechanical actuating device, control a locking device 8 of the rod assembly. As also shown in FIG. 6, this locking device consists of a stop 28 formed on the rod assembly and of a latch 29 oscillating on the housing 1. In particular, in the example shown, the latch 29 oscillates on the support 18 that is integral with the housing 1. The latch 29 is constantly moved in the direction of arrow 30 by a spring, not shown, toward a position of engagement with the stop 28. This engagement, as shown in FIG. 6, is ensured in a closed position of the lock. Thus, any movement of the rod assembly 4 enabling a recoil of the bolts 3 is prevented as long as the unlocking of the rod 4 is not ensured.

The electric control of the latch 29 is ensured by an electromagnet 31 whose piston immediately brings the latch 29 to a distance from the stop 28, prior to actuating the electric motor 5.

In the event that there is a power failure, and the control of the opening device by the auxiliary mechanical actuating device, the control for the latch 29 is ensured by the interaction of a ramp 32, formed in the latch 29, and a pawl 33 carried on the upper part of the actuating arm 16. The downward movement of the actuating arm, in the first part of its course, results in the descent of the pawl 33 along the ramp 32 and thus the pivoting of the latch 29 up to its position 29' shown in a dotted line. It is only after this pivoting that the lower side 16' of the actuating arm 16 comes into contact with the projection 17 on the rod assembly 4. The continuation of the course of the actuating arm 16 ensures the lowering of the rod assembly 4 and the opening of the lock, the pawl 33 following its downward course along the ramp 32.

According to this embodiment, once the lock is opened by the auxiliary mechanical actuating device 7, it is reset, by a suitable action on the key actuating the cylinder 27, in a top closing position as shown in continuous lines in FIG. 4. When the power is returned, it enables the electric motor 5 to actuate the rod assembly 4 up to a closing position of the lock, the latch 29 being thus pushed back by the stop 28 against the action of the spring (arrow 30), until it rebounds under the stop 28 and is in a locking position. This movement of the latch 29 is obtained, moreover, for each closing by the electric control of the door, subsequent to an opening by this same electric control.

Figure 7:
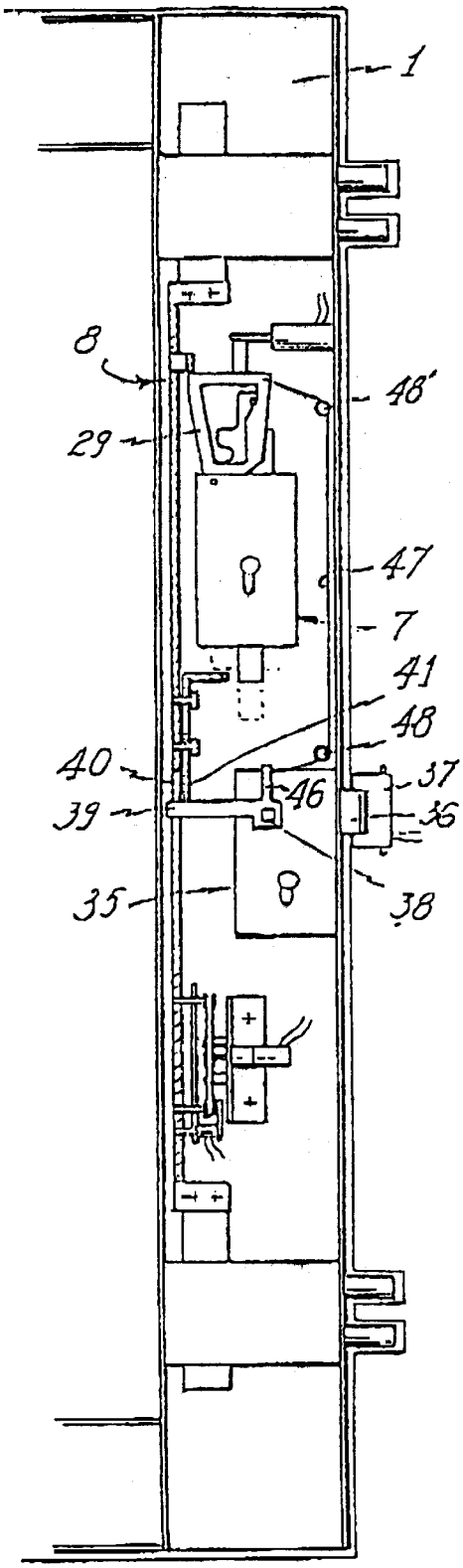
FIG. 7 is a schematic plan view of an especially preferred embodiment of a lock according to the invention, FIG. 8 a schematic perspective view of a part of the rod assembly and different control means associated therewith, FIGS. 9*a,* 9*b,* 9*c* schematically illustrate various steps for opening the door shown in FIG. 7, under the action of an electric command of the lock.
Figure 8:
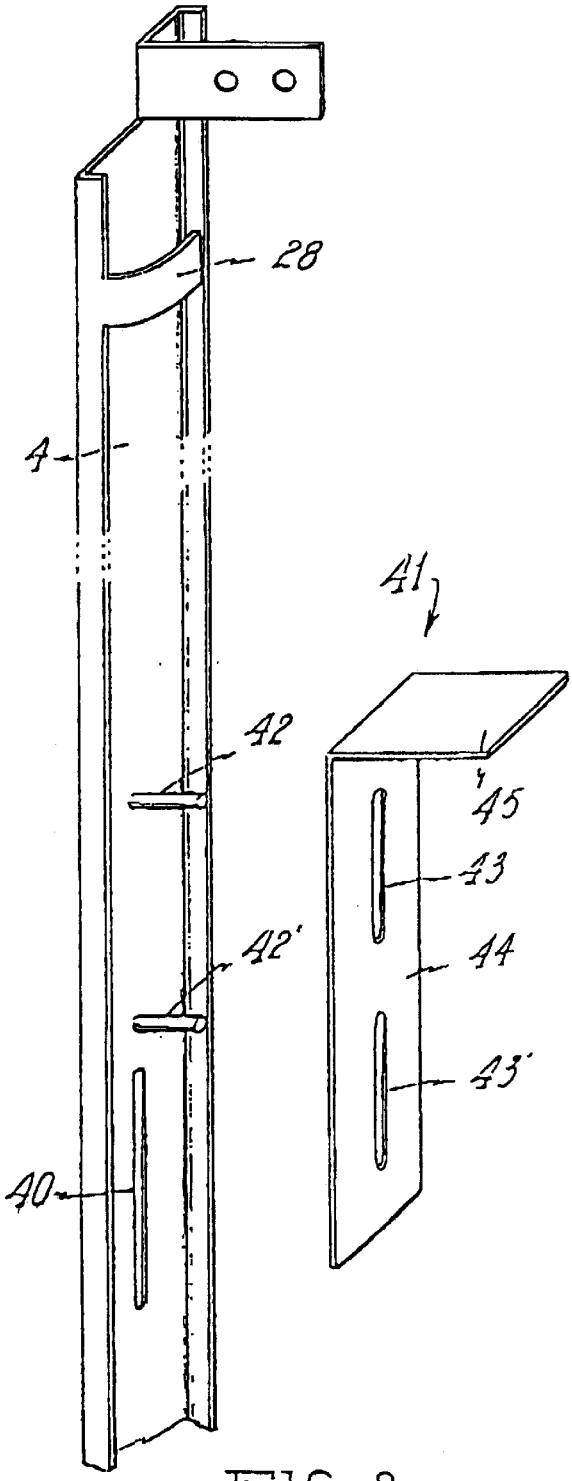

An especially preferred embodiment of the invention is, in fact, schematically illustrated in FIG. 7.

This embodiment comprises, in addition to the elements already described in association with FIG. 4, a latch lock 35 the tongue 36 of which interacts with an electric catch 37. This electric catch 27 is, of course, normally controlled by the electric opening control of the door.

The mechanical actuating device 38 of the latch lock 35 is integral with a lever 39 coming into interaction with the rod assembly 4 via a slot 40. Moreover, an L-shaped element 41 slides on the rod assembly 4 by the interaction of the pins 42, 42', an integral part of the rod assembly, with the slots 43, 43' formed in the large arm 44 of the L-shaped element 41. This L-shaped element 41 forms, by its small arm 45, the projection on the rod assembly intended to interact with the control arm 16 of the auxiliary mechanical actuating device 7.

The L-shaped element 41 is situated on the rod assembly, seen in a closed position, such that, when it rests on the upper end of its slots 43, 43' on the pins 42, 42' of the rod assembly, the end of its large arm 44 comes into contact with the lever 39 in a position of rest, corresponding to the rest position of the actuating mechanism 38 of the quarter-turn lock 35. The length of the slots 43, 43' corresponds more or less to the length of travel of the rod assembly (4) between the closed position and the open position of the lock.

Moreover, in this same closed position of the lock, the lever 39 is situated in the slots 40 in such a way that the length of the slot 40 situated above the lever 39 also corresponds more or less to the length of travel of the rod assembly between the closed position and the open position of the lock. The slot 40 extends, moreover, an additional length, the purpose of which will be explained below, under the lever 39.

The lever 39 comprises an arm 46 suitably joined—in the schematically illustrated example shown in FIG. 7, by means of a cable 47 and pulleys 48, 48'—to the latch 29 of the locking device 8 of the rod assembly 4.

Figure 9A:
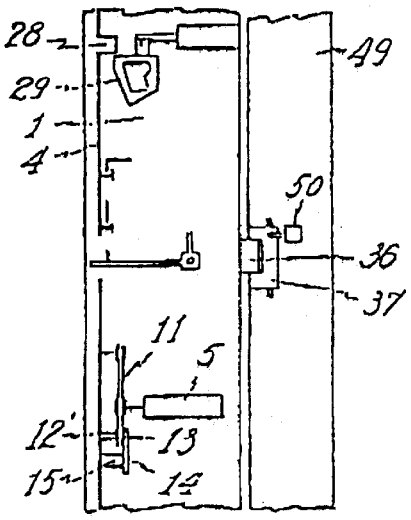

The various operating modes of this lock, from the closing position to the opening position, are schematically shown in FIGS. 9*a, b, c;* 10*a, b, c* and 11*a, b, c,* respectively, and commented on below.

Generally, in these various figures, only the intervening elements in the operational mode under consideration are schematically shown.

In each of these figures, a housing 1, containing the lock and forming the stile of the wing and the corresponding stile 49 of the frame, respectively, are shown. When the wing interacts with the frame, only the tongue 36 of the latch lock in the wing and the electric catch 37 in the frame, are shown. The position of the bolts, not shown in these figures, in their corresponding cavity in the frame, works, as described above, as a function of the position of the rod assembly 4.

Each of the FIGS. 9*a,* 10*a,* 11*a* show the lock in a closed position, that is, the rod asssembly 4 in a high position, the bolts projecting into their cavity in the frame and the electric catch 37 being blocked in rotation (which is schematically illustrated in the drawing by the action of an electromagnet 50).

FIGS. 9*a,* 9*b,* 9*c* show the functioning of the electric control elements of the lock, i.e. its normal functioning.

In FIG. 9*a,* the rod assembly 4 is in a high position, its locking is ensured by the engagement of the latch 29 under the stop 28, the catch 37 is blocked and interacts with the tongue 36, the bolts are engaged in their respective cavities in the frame 49 and the coupling 15 is supplied with power, ensuring the blocking of the pinion 14 and, via pinion 13, the blocking of the pulley 12' and thus the notched belt 11.

Figure 9B:
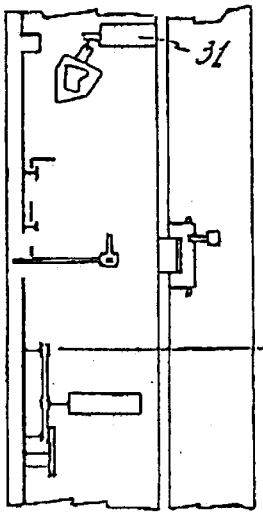

In FIG. 9*b,* the door opening assembly has jut been given. The electromagnet 31 is supplied with power and draws the latch 29 to it, ensuring the unlocking of the rod assembly 4. The motor 5 is supplied with power while the coupling 15 also remains supplied. The rotation of the pinion 10 at the outlet of the drive shaft, combined with the blockage of the notched belt 11, causes the displacement of the rod assembly 4 toward the open position for the lock and the progressive withdrawal of the bolts from their cavities. According to a preferred embodiment of the invention, the control of the electric catch 37 is time-delayed to keep the catch 37 in a closed position as long as the bolts have not been fully withdrawn from their cavities. This provision makes it possible to avoid, by an untimely push exerted by the user on the door when it is being opened, that the bolts are jammed in their cavities during their withdrawal movement, producing an overload of the motor 5 or even perhaps a complete blockage of the opening movement. Keeping the electric catch 37 in a closed state, interacting with the tongue 36, makes it possible to release the bolts from any stress resulting from such an untimely push and thus ensures a correct functioning of the lock in every case until it is in an open position.

Figure 9C:
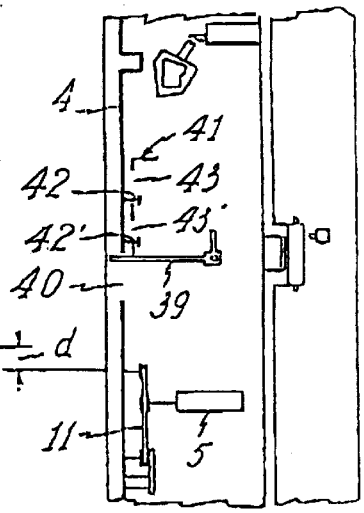

Once the open position of the lock has been attained (FIG. 9*c*), the notched belt 11, blocked on the pulleys 12, 12', is moved by the action of the motor 5 by a distance d, carrying the rod assembly 4 along in its downward movement. The electric catch 37 is simultaneously released, its pivotal movement enabling the release of the tongue 36 and thus the opening of the door. It should be noted that, during this downward movement of the rod assembly 4, no action was exerted on either the L-shaped element 41 nor on the lever 39 actuating the latch lock 35. This downward movement of the rod assembly 4 only results in a displacement of the pins 42, 42' in their respective slots 43, 43' and of the lever 39 vis-à-vis its slot 40.

When the lock is returned to its closed position (not shown), the door is first of all closed and the tongue 36 rebounds past the catch 37 that is again blocked. The rod assembly then rises into the closed position by the action of the motor 5 on the notched belt 11 that is still blocked. This movement continues until the stop 28 passes beyond the latch 29 which rebounds the stop 28 by the action of its spring (arrow 30 in FIG. 6) and the rod assembly 4 comes to rest in the closed position, locked.

Figure 10A:
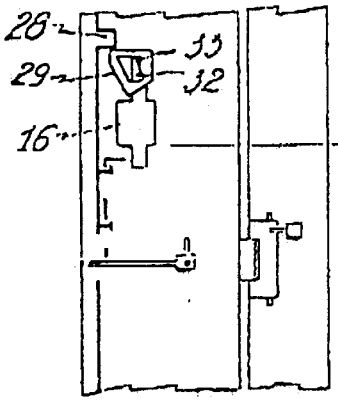
FIGS. 10, 10*b*, 10*c* illustrate the corresponding steps for opening the door shown in FIG. 7 when an auxiliary mechanical actuating device is used.

In case of a power failure, the door can be opened with aid of an auxiliary mechanical actuating device, as shown in FIGS. 10 *a, b,* and *c.*

In a closed position of the door (FIG. 10*a*), the rod assembly 4 is in a high closed position of the lock, the actuating arm 16 of the auxiliary mechanical actuating device (see FIGS. 5 and 6) is also in a high position, the latch 29 is engaged under the stop 28 of the locking device of the rod assembly and the pawl 33 from the upper part of the actuating arm 16 interacts with the upper part of the ramp 32 formed in the latch 29.

Figure 10B:
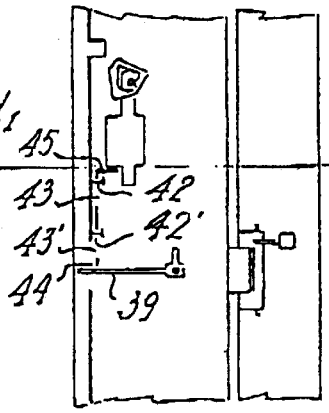

Lowering a first notch of the actuating arm 16 by the action of a key in the lock 27 resulting in the rotation of a turn of the bolt 26 (see FIG. 5) causes the downward movement of the actuating arm 16 in its support by a distance $d_1$, and concurrently therewith the downward movement of the pawl 33 along the ramp 32 and then the pivoting of the latch 29 at a distance from the stop 28. The rod assembly 4 is thus unlocked, while the actuating arm 16 is brought into contact with the small arm 45 of the L-shaped element 41. This is shown in FIG. 10*b.*

Figure 10C:
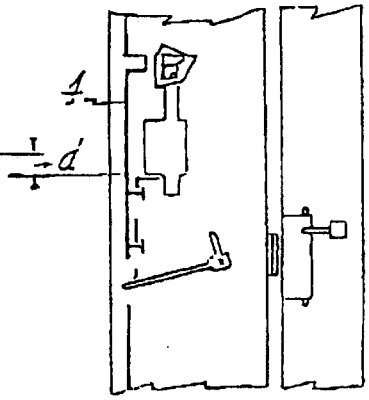

A further lowering of the actuating arm 16 exerts a push on the small arm 45 of the L-shaped element 41. This push is transmitted, on the one hand, to the rod assembly 4 by the end of the slots 43, 43' pushing on the pins 42, 42' of the rod assembly and, on the other hand, to the actuating lever 39 of the latch lock by the end of arm 44. This lowering movement of the actuating arm 16 is continued until the rod assembly has descended to the open position and until the pivoting of the lever simultaneously pushes aside the tongue (FIG. 10*c*). The door can then be opened.

It should be noted that, as previously stated in association with the description of FIGS. 2 and 3, in case of a power failure, the coupling 15 (not shown in FIGS. 10) is released and the rod assembly 4 can then move without it being necessary to drive the motor, which reduces the stress to be exerted on the actuating arm 16.

Once the door is open, the actuating arm 16 returns to its high position which, on the one hand, releases the latch 29 in rotation and, on the other hand, releases the arm 45 from the action of the actuating arm 16 and enables the lever 39 to return to its normal position and thus the tongue to return to its closed position. This step is not shown in the drawing.

It should be noted that throughout the various steps of FIG. 10, the catch 37 remains locked. Thus when the actuating arm 16 has been completely raised again due to an appropriate action on the auxiliary mechanical actuating device 7, the door can be closed again. It will remain closed even if there is a power failure, thereby that the tongue 36 rebounds past the catch 37. When power is returned, the appropriate detectors, not shown, will detect the state of the rod assembly in an open position and the motor 5 will be actuated to bring it to a closed position.

Figure 11A:
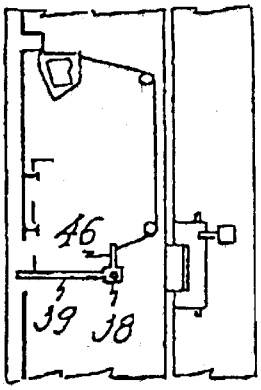
FIGS. 11*a*, 11*b* and 11*c* show the corresponding steps for opening the door shown in FIG. 7 when use is made, moreover, of a latch lock.

Finally, as shown in FIGS. 11*a, b* and *c,* a latch lock (35 in FIG. 7) can also be used to open the door.

In a closed position of the lock (FIG. 11*a*), the rod assembly 4 is in a high closed position, the latch 29 interacts with the stop 28 to ensure the locking of the rod assembly and the actuating lever 39 of the latch lock is in a rest position, the tongue 36 projecting from the lock to interact with the electric catch 37 blocked in rotation.

Figure 11B:
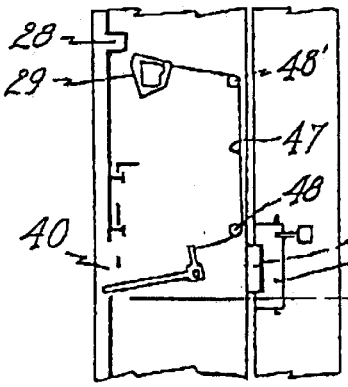
Figure 11C:
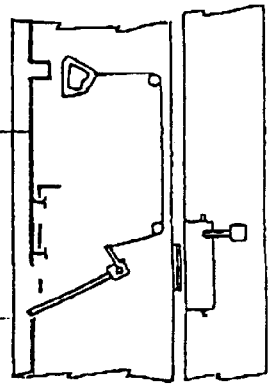

A first action on the actuating device 38 of the latch lock causes the lever 39 and its arm 46 to rotate until the position shown in FIG. 11*b* is attained. In this position, the lever 39 comes into contact with the base of the slot 40, while the lever 46 exerts a traction on the cable 47, resulting in the disengagement of the latch 29 from the locked position of the rod assembly 4 which can then be moved toward the open position. This first pivoting of the lever 39 also results in a first withdrawal of the tongue 36.

Continuing the action on the actuating device 38 in the same direction results in a further rotation of the lever 39. The end thereof that is in contact with the rod assembly 4, in the base of the slot 40, drives the rod assembly 4 until it is in the open position while the tongue is also completely withdrawn. The door can thus be opened very quickly.

The actuating device 38 is, for example, actuated by a "panic bar" by the action of a push exerted on the bar. Preferably, this bar is automatically returned into its rest position when the push stops which enables the return of the tongue 36 projecting on the lock. A door can thus be closed by being kept closed at least by the interaction of the tongue and the catch. If, in the circumstances involving the use of the panic bar, the power was maintained, nothing prevents the door from being completely locked again, by the action of electric controls, once the door has returned into the closed position which is confirmed by appropriate detectors. If required, this makes it possible to avoid, once the premises have been evacuated, closing them again, perhaps automatically by an appropriate device, and makes it also possible to keep them closed so as to be secure against any malicious intrusion.

Various means exist to regulate the use of such a "panic bar". Thus, there are reliable and extremely quick means available to open, if required, a door closed by a multipoint electric lock.

All of the devices described above are produced from simple elements, that can generally be obtained by cutting from sheet metal and folding, resulting in lower manufacturing costs. Moreover, their design allows them to be made in a modular form to enable an easily adaptable manufacture and assembly of locks having different dimensions.

According to a particularly preferred embodiment of the invention, the housing 1 of the lock also comprises a stile of the metal door which makes it even more possible to rationalize the manufacture of the door and the installation of the lock in the door and to thus reduce production costs even further.

It is understood that the housing 1 can consist of the stile of the wing as well as of the frame of the door.

What is claimed is:

1. In an electrical mortise lock having a chute-type housing having a cover, said housing accommodating a lock means, said lock means having:

lock actuating means (5), comprising an electric motor and actuating means;

a control rod assembly (4) movable longitudinally in said housing;

at least two mutually spaced-apart lock means (2,2') capable of projecting from said housing when said lock is in a closed position;

said rod assembly (4) directly connecting said spaced-apart lock means (2, 2') together, integral with the housing, and sliding in the housing, guided thereon by means of said spaced apart lock means (2, 2');

transmission means (6, 6') for effecting movement between said lock actuating means (5) and said rod assembly (4);

said electric motor (5) controlling said rod assembly (4) both in an opening and closing direction through said transmission means (6, 6'); and auxiliary mechanical actuating means (7) adapted to control, through a further transmission means (7, 41) and independently from the lock actuating means, said rod assembly (4) in an opening direction; the improvement wherein;

said housing (1) accommodates, in addition to said rod assembly (4), said lock actuating means (5) and said auxiliary mechanical actuating means (7); and said lock actuating means (5) and said auxiliary mechanical actuating means (7) are separated from each other, in spaced-apart relationship in said housing (1) over a length of said rod assembly (4).

2. A mortise lock according to claim 1, wherein:

said motor (5) is integral with said housing (1);

said lock means includes a drive means (10) and a receptacle (11, 12, 12') for said transmission means;

said drive means (10) and said receptacle (11, 12, 12') for said transmission means (6') being directly connected, respectively, to an output shaft (9') of said motor and said rod assembly (4); and said auxiliary actuating means (7) directly controlling said rod assembly (4) without interfering with movement of said rod assembly (4).

3. A lock according to claim 2, wherein:

said transmission means includes a coupling (15) to permit disengagement between said electric motor (5) and said rod assembly (4) at least in the opening direction thereof, and said auxiliary actuating means (7) controls said rod assembly (4) in an opening direction, said rod assembly (4) being disengageable from the control of said auxiliary actuating means (7) when the latter is in a closed position.

4. A lock according to claim 3, wherein said transmission means (6') comprises, on the one hand, a drive pin (10) mounted at the outlet of a speed reducer (9), integral with the motor (5), and, on the other hand, with a notched belt (11), kept engaged with said drive pin (10) and held between two return pulleys (12, 12') mounted so as to pivot on the rod assembly (4), an electromagnetic coupling (15) acting on at least one (12') of the return pulleys to block said at least one of said return pulleys in rotation, wherein this coupling can be disengaged in case of a power failure to release the pulley (12') and thus make it possible to wind the notched belt (11) on said pulley (12'), at least in the direction corresponding to the winding direction required to enable the rod assembly (4) to be opened.

5. A lock according to claim 3, wherein said auxiliary mechanical actuating means (7), actuated by a key, is a mechanical lock actuating a control arm (16) driven by a movement parallel to a direction of displacement of the rod assembly (4) and wherein the rod assembly (4) has a projection (17) situated in the path of the arm (16) considered in the direction of displacement of the rod assembly (4) toward the open position, to interact with said arm (16) when said arm is moved in the direction of opening of the rod assembly (4).

6. A lock according to claim 5, wherein said rod assembly (4) further comprises a locking device (8) controlled both electrically and by the auxiliary mechanical actuating means (7).

7. A lock according to claim 6, wherein said locking device (8) consists of a latch (29) pivoting on the housing (1), constantly returned by a spring to a position of engagement with a stop (28) provided on the rod assembly (4) and actuated at a distance from this engaged position, simultaneously by the piston of an electromagnet (31) controlled by an electric device controlling the opening of the door and by a pawl (33), integral with the control arm (16) of the auxiliary mechanical actuating means (7), interacting with a ramp (32) formed in, the latch (29).

8. A lock according to claim 6 wherein there is further provided a latch lock (35) comprising a tongue (36) that is provided to interact with an electric catch (37), normally controlled concurrently with the locking device, is integrated in the mortise lock and wherein the movement of the tongue (36) of said latch lock (35) at a distance from the catch (37) is controlled by way of an actuating element (38) of said latch lock (35), by the auxiliary mechanical actuating means (7).

9. A lock according to claim 8 wherein said actuating element (38) of the latch lock (35) also controls the rod assembly (4), only in the direction of opening, as well as the rocking of the latch (29) of the rod assembly (4).

10. A lock according to claim 9, wherein the projection on the rod assembly (17), subjected to the action of the control arm (16) of the auxiliary mechanical actuating means (7), consists of a small arm (45), situated on an upper part of a reversed L-shaped element (41), a large arm (44) of which is situated parallel to the rod assembly (4) and rests, with a lower end, on an actuating lever (39) of the latch lock (35), wherein the large arm (44) of the L-shaped element (41) is connected to the rod assembly by slots (43, 43'), the length of which corresponds, at least approximately, to an opening path of the rod assembly (4), and pins (42, 42') and wherein the end of the actuating lever (39) of the latch lock (35) engages in a slot (40) of the rod assembly, the length of the slot (40) being such that the slot provides said lever (39), in said slot, with a course corresponding to the opening path of the rod assembly (4) augmented by a preliminary unlocking course of the latch (29), and wherein the actuating element (38) of the latch lock (35) is connected to the latch (29) of the locking device (8) of the rod assembly (4) in such a way that start of the course of the actuating lever (39) of the latch lock (35), in the corresponding slot (40) of the rod assembly (4) results in the withdrawal of the locking latch (29) in an unlocked position.

11. A lock according to claim 10, wherein said housing (1) of the lock consists simultaneously of a single casing accommodating all of the spaced apart lock means (2, 2'), the rod assembly (4), the lock actuating means, the auxiliary mechanical actuating means (7), the latch lock means (35') and the transmission means (6, 6') between the lock actuating means (5) and the rod assembly (4), and door stile.

12. A lock according to claim 11, wherein said lock housing consists of a stile of a wing of a metal door.

13. A lock according to claim 11, wherein said lock housing consists of the stile of a frame of a metal door.

14. A lock according to claim 5, wherein said auxiliary mechanical actuating means (7) consists of a support (18), integral with the housing (1), of an actuating cylinder (27) for said lock carried by the support (18), and of the control arm (16), sliding on the support (18) through the use of slots (19, 19') in which guides (20, 20') carried by the support (18) engage, the control arm (16) comprising two series of notches, namely a first series of notches, called actuating notches (22) provided for interacting with the bolt (26) of the actuating cylinder (27) to ensure the displacement of the control arm (16), and a second series of notches, called blocking notches (21), provided for interacting with a blocking pin (23) resiliently and permanently urged toward an engaged position with the blocking notches, said blocking pin (23) being carried by a lever (24) mounted so as to oscillate on the support (18) and controlled so as to rock by the bolt (26) of the cylinder (27) to distance the blocking pin (23) from the notch (21) in which the blocking pin is engaged, when the bolt (26) of the cylinder (27) engages with the corresponding actuating notch (22), so as to ensure the actuating of the arm (16), this action of the bolt (26) on the oscillating lever (24) being interrupted as soon as the control arm (16) has started movement, so that the pin (23) is again resiliently urged toward an engaged position and can thus again fall into the next blocking notch (21), the position of which corresponds to the end of the displacement cycle of the control arm (16) resulting from the action of the bolt (26) on the corresponding actuating notch (22).

15. A lock according to claim 14, wherein said control arm (16) consists of two parallel plates having an identical profiled section and assembled so as to be mutually spaced, and wherein the lever (24) carrying the blocking pin (23) is mounted so as to oscillate on one of the guides (20) engaging in the slots (19) of the control arm guide (24) and situated between the two plates comprising the control arm.

16. A lock according to claim 8, wherein said electric catch (37) is opened by means of a time switch in order to only allow the release of the tongue (36) after the locking bolts (3) have been completely withdrawn from their respective housings.

17. In an electrical mortise lock having a chute-type housing having a cover, said housing accommodating a lock means, said lock means having:

a lock actuating means (5), comprising an electric motor and actuating means, said electric motor integral with said housing (1);

a control rod assembly (4) movable longitudinally in said housing;

at least two mutually spaced-apart lock means (2, 2') capable of projecting from said housing when said lock is in a closed position;

said rod assembly (4) directly connecting said spaced-apart lock means (2, 2') together, integral with the housing, and sliding in the housing, guided thereon by means of said spaced apart lack means (2, 2');

transmission means (6, 6') for effecting movement between said lock actuating means (5) and said rod assembly (4), said transmission means (6') including a drive means (10) and a receptacle (11, 12, 12');

said drive means (10) and said receptacle (11, 12, 12') for said transmission means (6') being directly connected, respectively, to an output shaft (9') of said motor and said rod assembly (4);

said electric motor (5) controlling said rod assembly (4) both in an opening and closing direction through said transmission means (6, 6'); and auxiliary mechanical actuating means (7) adapted to directly control said rod assembly (4) in an opening direction without interfering with movement of said rod assembly (4), said rod assembly (4) being disengageable from the control of said auxiliary actuating means (7) when said latter is in a closed position, the improvement wherein:

said housing (1) accommodates, in addition to said rod assembly (4), said lock actuating means (5) and said auxiliary mechanical actuating means (7);

said lock actuating means (5) and said auxiliary mechanical actuating means (7) are separated from each other, in spaced-apart relationship in said housing (1) over a length of said rod assembly (4); and said transmission means is effective to permit disengagement between said electric motor (5) and said rod assembly (4) at least in the opening direction thereof, said transmission means comprising a drive pin (10) mounted at the outlet of a speed reducer (9), integral with the motor (5) and a notched belt (11), kept engaged with said drive pin (10) and held between two return pulleys (12, 12') mounted so as to pivot on the rod assembly (4), an electromagnetic coupling (15) acting on at least one (12') of the return pulleys to block said at least one return pulley in rotation, wherein this coupling can be disengaged in case of a power failure to release the pulley (12') and thus make it possible to wind the notched belt (11) on said pulley (12'), at least in the direction corresponding to the winding direction required to enable the rod assembly (4) to be opened.

* * * * *